US007486259B2

(12) United States Patent
Kang et al.

(10) Patent No.: US 7,486,259 B2
(45) Date of Patent: Feb. 3, 2009

(54) PLASMA DISPLAY PANEL AND METHOD FOR DRIVING THE SAME

(75) Inventors: Kyoung-Ho Kang, Suwon (KR); Dae-Gyu Kim, Cheonan (KR); Shigeo Mikoshiba, Tokyo (JP); Makoto Ishii, Tokyo (JP); Akira Gotoda, Tokyo (JP); Kiyoshi Igarashi, Tokyo (JP)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 325 days.

(21) Appl. No.: 11/153,453

(22) Filed: Jun. 16, 2005

(65) Prior Publication Data

US 2005/0218818 A1 Oct. 6, 2005

(51) Int. Cl.
*G09G 3/28* (2006.01)

(52) U.S. Cl. ..... 345/60; 345/63; 345/66; 345/67; 345/68

(58) Field of Classification Search ..... 345/60, 345/63, 66–68, 55, 204; 315/167, 169.1–169.4; 313/582

See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.
5,724,054 A 3/1998 Shinoda
5,786,794 A 7/1998 Kishi et al.
5,835,072 A * 11/1998 Kanazawa ..... 345/60
5,952,782 A 9/1999 Nanto
6,020,687 A 2/2000 Hirakawa et al.
6,087,779 A * 7/2000 Sakamoto et al. ..... 315/169.1

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Prabodh M Dharia
(74) *Attorney, Agent, or Firm*—Robert E. Bushnell, Esq.

(57) ABSTRACT

A technique for driving a PDP, which includes scan and sustain electrodes arranged in pairs, data electrodes arranged alternately with the scan electrodes, and sub-fields for one TV field to display a multi-gradation, includes applying a reset pulse voltage to the sustain electrodes, applying a first voltage alternately to the scan electrodes and the sustain electrodes to cause a sustain discharge, and after applying a second voltage to the sustain electrodes or removing part of the first voltage applied to the sustain electrodes, applying third and fourth voltages to the scan electrodes and the data electrodes, respectively, before applying the first voltage, to erase wall charges in cells defined by the sustain electrodes, the data electrodes, and the scan electrodes.

20 Claims, 9 Drawing Sheets

U.S. PATENT DOCUMENTS

| | | | | |
|---|---|---|---|---|
| 6,232,935 | B1 * | 5/2001 | Fukushima et al. | 345/67 |
| 6,256,002 | B1 * | 7/2001 | Shinoda | 345/60 |
| 6,292,159 | B1 * | 9/2001 | Someya et al. | 345/60 |
| RE37,444 | E | 11/2001 | Kanazawa | |
| 6,320,326 | B1 | 11/2001 | Shino et al. | |
| 6,373,451 | B1 * | 4/2002 | Kang et al. | 345/60 |
| 6,417,824 | B1 * | 7/2002 | Tokunaga et al. | 345/60 |
| 6,492,776 | B2 | 12/2002 | Rutherford | |
| 6,495,968 | B2 * | 12/2002 | Tokunaga | 315/169.4 |
| 6,630,916 | B1 | 10/2003 | Shinoda | |
| 6,653,795 | B2 * | 11/2003 | Kang et al. | 315/169.3 |
| 6,707,436 | B2 * | 3/2004 | Setoguchi et al. | 345/60 |
| 6,710,755 | B1 * | 3/2004 | Shiozaki et al. | 345/60 |
| 6,909,244 | B2 * | 6/2005 | Kang et al. | 315/169.4 |
| 7,027,012 | B2 * | 4/2006 | Kuroki et al. | 345/60 |
| 7,042,424 | B2 * | 5/2006 | Shigeta et al. | 345/63 |
| 2002/0014848 | A1 * | 2/2002 | Tokunaga | 315/169.1 |
| 2002/0033675 | A1 * | 3/2002 | Kang et al. | 315/169.1 |
| 2003/0067425 | A1 * | 4/2003 | Tokunaga et al. | 345/60 |
| 2004/0061669 | A1 * | 4/2004 | Kang et al. | 345/60 |
| 2004/0251829 | A1 * | 12/2004 | Kuroki et al. | 313/582 |
| 2005/0088370 | A1 * | 4/2005 | Shigeta et al. | 345/60 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2002-023693 | 1/2002 |

* cited by examiner

PLASMA DISPLAY PANEL AND METHOD FOR DRIVING THE SAME

CLAIM OF PRIORITY

This application makes reference to, incorporates the same herein, and claims all benefits accruing under 35 U.S.C. §119 from an application for "PLASMA DISPLA YPANEL AND METHOD FOR DRIVING THE SAME" earlier filed in the Korean Intellectual Property Office on 23 Jul. 2002 and there duly assigned Ser. No. 2002-43250, and under 35 U.S.C. §120 from an application entitled "PLASMA DISPLAY PANEL AND METHOD FOR DRIVING THE SAME" earlier filed in the United States Patent & Trademark Office on the 22$^{nd}$ of Jul. 2003 and there duly assigned Ser. No. 10/623,714, and subsequently issued as U.S. Pat. No. 6,909,244 on the 21$^{st}$ of Jun. 2005.

BACKGROUND OF THE INVENTION

1. Field of the Invention

The present invention relates to a plasma display panel and a method for driving the same.

2. Description of the Related Art

A plasma display panel (PDP) is a type of display device that has a plurality of discharge tubes arranged in a matrix form, and it selectively makes them radiate to reconstitute picture data input as electrical signals. The driving method of the PDP is classified into a DC (direct current) driving method and an AC (alternating current) driving method, according to whether or not the polarity of the voltage applied to sustain a discharge is changed with an elapse of time.

The general PDP is a display device in which an ultraviolet ray emitted from a discharge of each pixel cell excites a fluorescent material coated on the inner wall of the pixel cell to realize a desired color. To achieve color display, the PDP must exhibit an intermediate gradation. The method for exhibiting an intermediate gradation that is currently used involves dividing one TV field into a plurality of sub-fields and subjecting the sub-fields to time division control.

There are two methods for exhibiting an intermediate gradation: an ADS (Address Display Separated) driving method and an AWD (Address While Display) driving method.

As an example in the ADS driving method, in order to display a 256-gradation image, one frame is time-divided into eight sub-fields, each of which is subject to time division into a reset period to initialize a screen, an address period to sequentially scan the screen and write data, and a sustain discharge period to sustain the luminescent status of each data-written discharge cell for a predetermined period of time, thereby driving the PDP. Here, the address period is allocated equally to each sub-field, but the sustain discharge period is allocated to the respective sub-fields at a rate of $2^n$ (0, 1, 2, . . . , 7). Then the respective sub-fields realize a gradation in proportion to the sustain discharge period, and the gradations of the respective sub-fields are combined into a gradation for an image of one frame.

The ADS driving method is problematic in that the brightness is too low, because the sustain discharge period is shorter than the address period. In addition, the sustain discharge must be activated again after addressing the whole screen, so that wall charges generated in the discharge cells are heterogeneous due to the elapsed time for the address period, thereby causing a false discharge and a heterogeneous discharge during the sustain discharge period and hence a deterioration of the image quality.

Unlike the ADS driving method, the AWD driving method does not involve time division into a reset period, an address period, and a sustain discharge period. In the AWD driving method, a sustain discharge pulse of a predetermined frequency is successively applied to scan and sustain electrodes, and addressing is partly performed every period of the sustain discharge pulse. So the sustain discharge occurs over one frame without a discontinuance. Advantageously, the AWD driving method enhances the brightness because the sustain discharge period is sufficiently long.

In both the ADS driving method and the AWD driving method, however, the individual sub-fields consist of a reset period, an address period, and a sustain discharge period, and a large amount of ineffective light is generated due to reset and erase pulses in the reset period, resulting in a deterioration of contrast.

SUMMARY OF THE INVENTION

It is therefore, an object to provide an improved apparatus and technique for driving a PDP.

It is another object to provide an apparatus and technique for driving a PDP with no more than one reset pulse voltage being applied for one TV field without a reset step between the respective sub-fields, thereby drastically reducing ineffective light and improving the contrast.

It is yet another object to provide an apparatus and technique for driving a PDP with a plurality of scan and sustain electrodes being arranged so as to reduce the number of driver IC's for the scan and sustain electrodes, thereby lowering the cost of the PDP.

In accordance with the present invention contrast is drastically improved by applying a reset pulse voltage only once during one TV field while maintaining a high brightness.

In one aspect of the present invention, there is provided a method for driving a PDP which includes a plurality of first and second electrodes arranged in pairs, a plurality of data electrodes formed normal to the first and second electrodes, and a plurality of sub-fields for one TV field to display a multi-gradation, the method including: (a) a reset step of applying a reset pulse voltage to the first electrodes; (b) a sustain discharge step of applying a first voltage alternately to the first electrodes and the second electrodes to cause a sustain discharge; and (c) an address erasure step of, after applying a second voltage to the first electrodes or removing part of the first voltage applied to the first electrodes, applying third and fourth voltages to the second electrodes and the data electrodes, respectively, before applying the first voltage, to erase wall charges in cells defined by the first electrodes, the data electrodes, and the second electrodes.

In another aspect, there is provided an apparatus for driving a PDP which includes a plurality of first and second electrodes arranged in pairs, a plurality of data electrodes formed normal to the first and second electrodes, and a plurality of sub-fields for one TV field to display a multi-gradation, the apparatus including: a first driver for applying a voltage for sustain discharge to the first electrodes by periods, and applying a first voltage to the first electrodes of cells selected for erasure of the sustain discharge or removing the voltage for sustain discharge to erase the sustain discharge; a second driver for applying the voltage for sustain discharge to the second electrodes, and applying a second voltage to the second electrodes of cells selected for erasure of the sustain discharge; and a third driver for applying a third voltage to the data electrodes of cells selected for erasure of the sustain discharge.

In still another aspect of the present invention, there is provided a PDP including: first and second substrates; a plurality of first and second electrodes arranged in pairs; a plurality of data electrodes arranged alternately with the first electrodes and the second electrodes; a first driver for applying a first voltage to the first electrodes by periods to cause a sustain discharge, and applying a second voltage to the first electrodes of cells selected for erasure of the sustain discharge or removing the first voltage to erase the sustain discharge; a second driver for applying a third voltage to the second electrodes of cells selected for erasure of the sustain discharge before applying the first voltage, after applying the second voltage to the first electrodes or removing the first voltage from the first electrodes; and a third driver for applying a fourth voltage to the data electrodes of cells selected for erasure of the sustain discharge before applying the first voltage, after applying the second voltage to the first electrodes or removing the first voltage from the first electrodes.

Preferably, the plural first and second electrodes are divided into j groups each including i pairs of the first and second electrodes, and the plasma display panel further includes j first common lines and i second common lines, wherein the j first common lines are coupled independently to the j groups, the first electrodes of the one group are coupled in common to the first common line, and the i second electrodes of the same group are coupled independently to the i second common lines.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

Hereinafter, a description will be given as to a PDP according to an embodiment of the present invention with reference to FIGS. 1 and 2.

Figure 1:
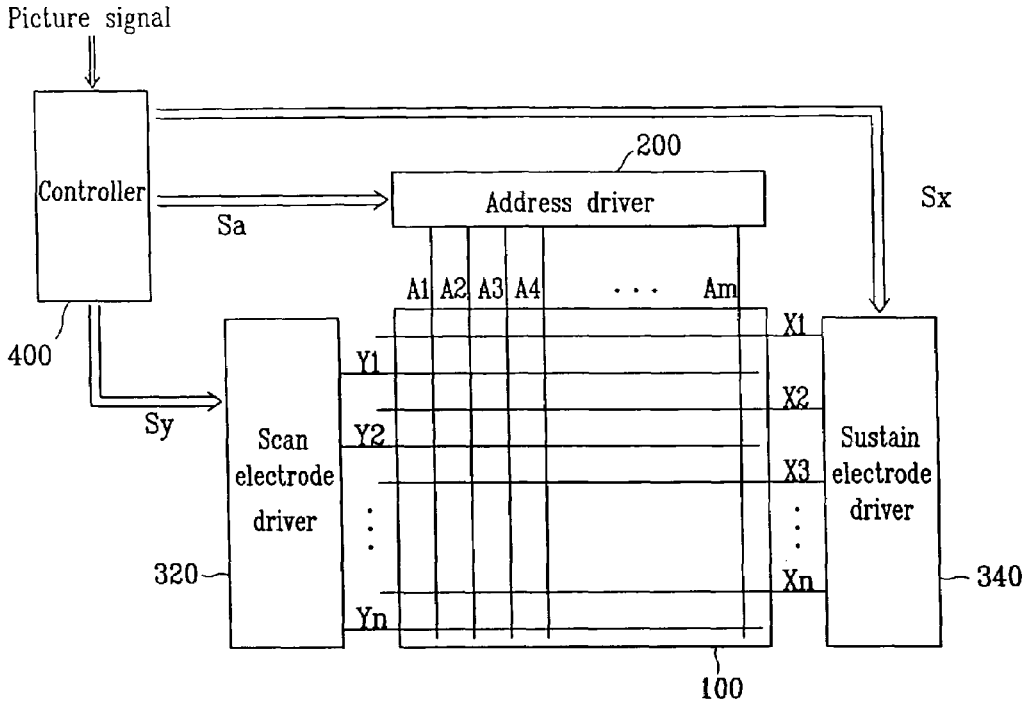
FIG. 1 is a schematic diagram of a PDP in accordance with an embodiment of the present invention.

FIG. 1 is a schematic diagram of the PDP according to the embodiment of the present invention.

The PDP according to the embodiment of the present invention includes, as shown in FIG. 1, a plasma panel 100, an address driver 200, a scan electrode (Y electrode) driver 320, a sustain electrode (X electrode) driver 340, and a controller 400.

The plasma panel 100 includes a plurality of data electrodes $D_1$ to $D_m$ arranged in columns, and a plurality of scan and sustain electrodes $Y_1$ to $Y_n$ and $X_1$ to $X_n$ alternately arranged in rows.

The address driver 200 receives an address drive control signal $S_a$ from the controller 400, and applies an address voltage for selection of a cell for erasure of sustain discharge to the corresponding data electrode.

The scan electrode driver 320 receives a scan electrode drive control signal $S_y$ from the controller 400 and applies a sustain discharge voltage to the respective scan electrodes at it predetermined intervals for sustain discharge, and a scan pulse voltage for selection of a cell selected to erase a sustain discharge to the corresponding scan electrode.

The sustain electrode driver 340 receives a sustain electrode drive control signal $S_x$ from the controller 400, and applies a sustain discharge voltage to the respective sustain electrodes at predetermined intervals for sustain discharge. As will be described later, the sustain electrode driver 340 according to the embodiment of the present invention does not apply a sustain discharge voltage to the sustain electrode for a cell selected to erase a sustain discharge.

The controller 400 externally receives a picture signal to generate the address drive control signal $S_a$, the scan electrode drive control signal $S_y$, and the sustain electrode drive control signal $S_x$, and applies the control signals to the address driver 200, the scan electrode driver 320, and the sustain electrode driver 340, respectively.

Figure 2:
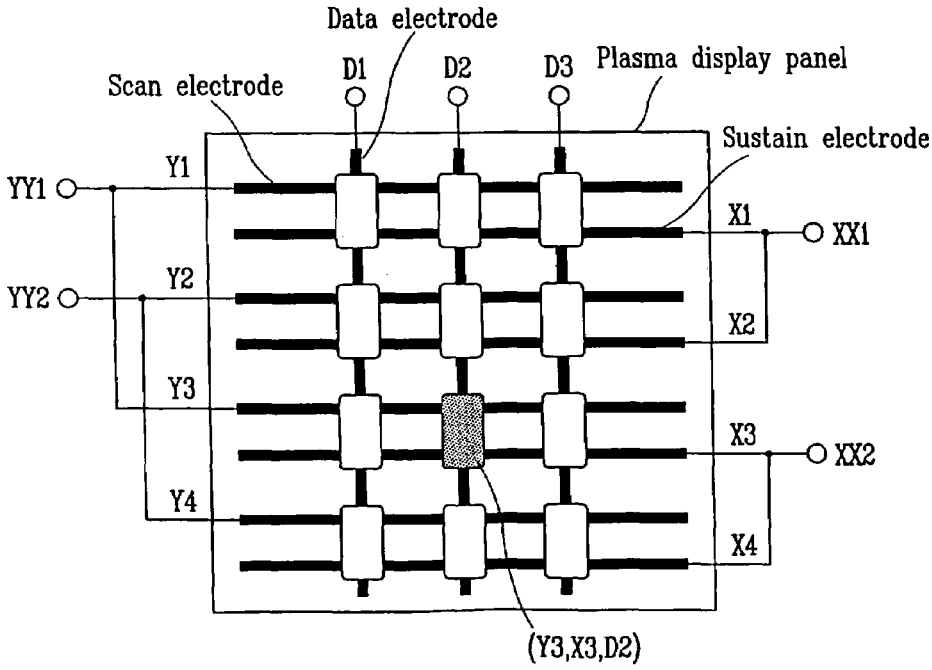
FIG. 2 is an electrode connection diagram of the PDP in accordance with an embodiment of the present invention.

FIG. 2 is an electrode connection diagram of the PDP according to an embodiment of the present invention. Expediently, the PDP as illustrated in the figure has four pairs of scan/sustain electrodes and three data electrodes.

In the figure, electrodes $Y_1$ to $Y_4$, electrodes $X_1$ to $X_4$, and electrodes $D_1$, $D_2$, and $D_3$ represent scan electrodes, sustain electrodes, and data electrodes, respectively. As shown in FIG. 2, the scan electrodes $Y_1$ to $Y_4$ and the sustain electrodes $X_1$ to $X_4$ are alternately arranged in rows, and the data electrodes $D_1$, $D_2$, and $D_3$ are arranged in columns.

In the PDP according to the embodiment of the present invention shown in FIG. 2, the electrodes are grouped in the units of four adjacent scan and sustain electrodes.

Namely, electrodes $Y_1$, $X_1$, $Y_2$, and $X_2$ are included in a first group, and electrodes $Y_3$, $X_3$, $Y_4$, and $X_4$ are included in a second group.

The first scan electrodes $Y_1$ and $Y_3$ of the first and second groups are coupled to a scan electrode common line $YY_1$, and the second scan electrodes $Y_2$ and $Y_4$ of the first and second groups are coupled to a scan electrode common line $YY_2$. Both the sustain electrodes $X_1$ and $X_2$ of the first group are coupled to a sustain electrode common line $XX_1$, and both the sustain electrodes $X_3$ and $X_4$ of the second group are coupled to a sustain electrode common line $XX_2$.

The PDP according to the embodiment of the present invention has scan and sustain driver ICs (integrated circuits), each of which is coupled to the common lines $YY_1$, $YY_2$, $XX_1$, and $XX_2$ for driving the scan and sustain electrodes. Accordingly, the number of driver IC's is remarkably reduced in comparison with the conventional PDP that has sustain electrodes coupled in common and scan driver IC's coupled to every scan electrode.

Hereinafter, a description will be given as to a method for driving a PDP in accordance with an embodiment of the present invention with reference to FIGS. 3A and 3B.

Figure 3A:
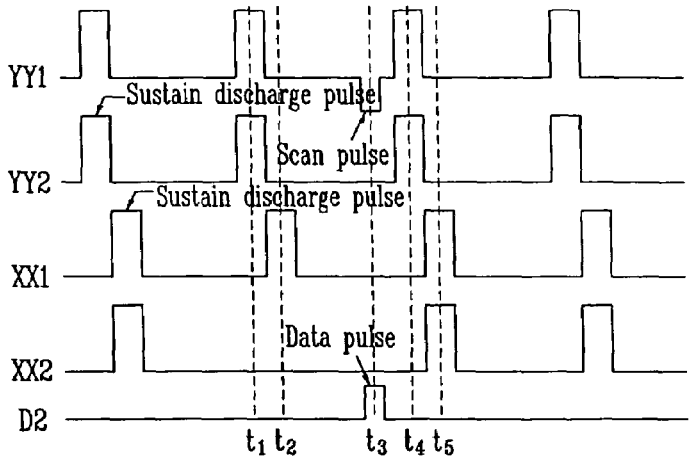
FIG. 3A is a waveform diagram of voltages applied to the common lines $YY_1$, $YY_2$, $XX_1$, and $XX_2$ and the data electrode $D_2$ of FIG. 2.

FIG. 3A is a waveform diagram of voltages applied to the common lines $YY_1$, $YY_2$, $XX_1$, and $XX_2$, and the data electrode $D_2$, which explains the method for driving a PDP according to the embodiment of the present invention. FIG. 3B illustrates a discharge and a wall charge status in each cell at the respective time points of FIG. 3A.

Referring to FIG. 3A, before $t_1$, a sustain discharge voltage (approximately 155 V) is applied alternately to the scan electrode common lines $YY_1$, and $YY_2$, and the sustain electrode common lines $XX_1$ and $XX_2$, to cause a sustain discharge in cells $Y_1$-$X_1$-$D_2$, $Y_2$-$X_2$-$D_2$, $Y_3$-$X_3$-$D_2$, and $Y_4$-$X_4$-$D_2$.

At $t_1$, the sustain discharge voltage is applied to the scan electrode common lines $YY_1$ and $YY_2$, and an electric potential of the sustain electrode common lines $XX_1$ and $XX_2$ is sustained at a ground voltage. As illustrated in FIG. 3B, a discharge occurs between the scan electrodes $Y_1$, $Y_2$, $Y_3$, and $Y_4$, and the sustain electrodes $X_1$, $X_2$, $X_3$, and $X_4$. Thus negative (−) wall charges are stored in the scan electrodes $Y_1$, $Y_2$, $Y_3$, and $Y_4$, and positive (+) wall charges are stored in the sustain electrodes $X_1$, $X_2$, $X_3$, and $X_4$. Priming particles are also generated in the discharge cells.

At $t_2$, the scan electrode common lines $YY_1$ and $YY_2$ are sustained at a ground potential, and a sustain discharge voltage is applied to the sustain electrode common line $XX_1$. But the sustain discharge voltage is not applied to the sustain electrode common line $XX_2$, which is sustained at the ground potential.

Figure 3B:
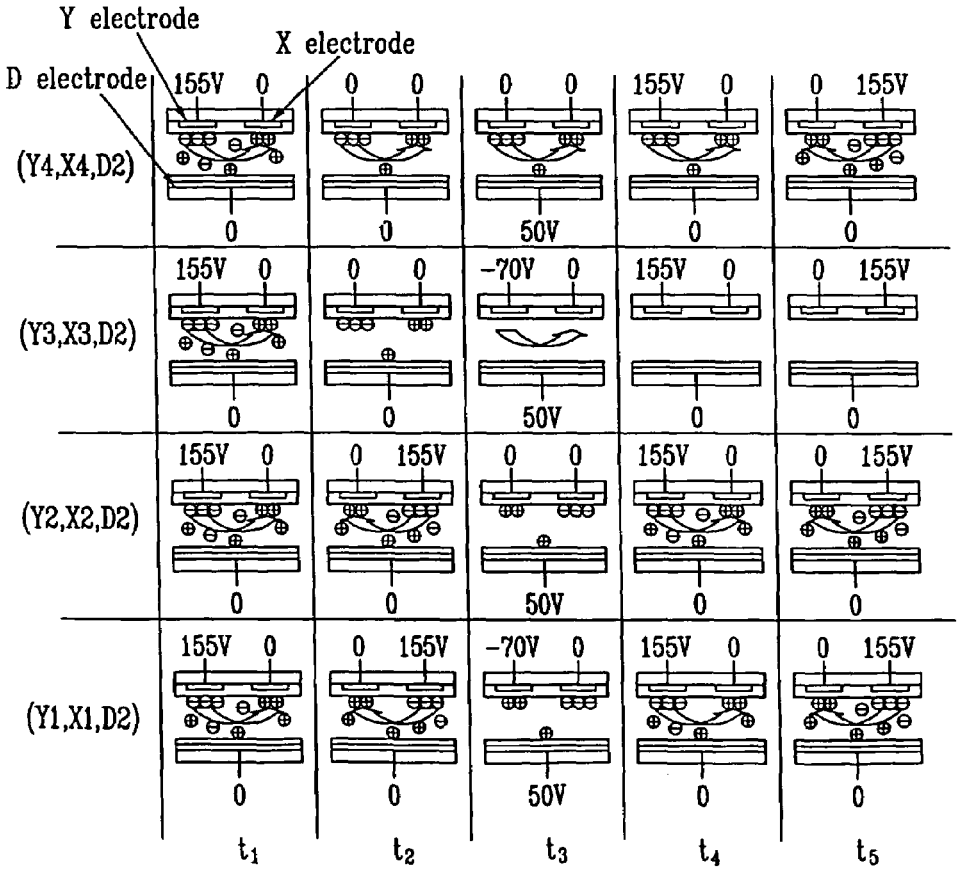
FIG. 3B illustrates a discharge and a wall charge status in each cell at the respective time points of FIG. 3A.

In the cells $Y_1$-$X_1$-$D_2$ and $Y_2$-$X_2$-$D_2$, a discharge occurs between scan electrodes $Y_1$ and $Y_2$ and sustain electrodes $X_1$ and $X_2$, as illustrated in FIG. 3B. Thus, positive (+) wall charges are stored in the scan electrodes $Y_1$ and $Y_2$, and negative (−) wall charges are stored in the sustain electrodes $X_1$ and $X_2$.

In the meantime, a discharge is not caused in the cells $Y_3$-$X_3$-$D_2$ and $Y_4$-$X_4$-$D_2$, so that there remain negative (−) wall charges in the scan electrodes $Y_3$ and $Y_4$ and positive (−) wall charges in the sustain electrodes $X_3$ and $X_4$.

At $t_3$, a scan pulse voltage (approximately −70 V) is applied to the scan electrode common line $YY_1$, and a data pulse voltage (approximately 50 V) is applied to the data electrode $D_2$, as illustrated in FIG. 3A. Then the wall charges of the cell $Y_3$-$X_3$-$D_2$ are all erased, as illustrated in FIG. 3B. With the wall charges erased, a discharge cannot be caused by an applied sustain discharge voltage. The wall charges in the other cells are sustained.

At $t_4$, a sustain discharge voltage is applied to the scan electrode common lines $YY_1$ and $YY_2$, and the ground voltage is applied to the sustain electrode common lines $XX_1$ and $XX_2$. In the cells $Y_1$-$X_1$-$D_2$ and $Y_2$-$X_2$-$D_2$, wall charges are generated: negative (−) wall charges in the scan electrodes $Y_1$ and $Y_2$ and positive (+) wall charges in the sustain electrodes $X_1$ and $X_2$ to cause a discharge, as illustrated in FIG. 3B. But a discharge does not occur in the cell $Y_4$-$X_4$-$D_2$ at $t_4$, because there remain negative (−) wall charges in the scan electrode $Y_4$ and positive (+) wall charges in the sustain electrode $X_4$.

In the cell $Y_3$-$X_3$-$D_2$, no discharge occurs even with a sustain discharge voltage at $t_4$, because wall charges in the cell are all erased at $t_3$.

At $t_5$, the ground voltage is applied to the scan electrode common lines $YY_1$ and $YY_2$, and a sustain discharge voltage is applied to the sustain electrode common lines $XX_1$ and $XX_2$. Then a discharge occurs in every cell except for the cell $Y_3$-$X_3$-$D_2$ to generate positive (+) wall charges in the scan electrodes $Y_1$, $Y_2$, and $Y_4$, and negative (−) wall charges in the sustain electrodes $X_1$, $X_2$, and $X_4$, as illustrated in FIG. 3B. But no discharge occurs in the cell $Y_3$-$X_3$-$D_2$, because wall charges in the cell are all erased at $t_3$.

As described above, the method for driving a PDP according to the embodiment of the present invention uses a 3-input AND logic operation for selection of cells for erasure of the sustain discharge. Namely, the inputs of the 3-input AND logic operation include removing a sustain discharge voltage pulse, applying a scan pulse voltage to scan electrodes, and applying a data pulse voltage to data electrodes, thereby erasing a sustain discharge.

Hereinafter, a description will be given as to an operational margin of the driving voltage for the PDP according to the embodiment of the present invention, with reference to FIGS. 4 and 5.

Figure 4:
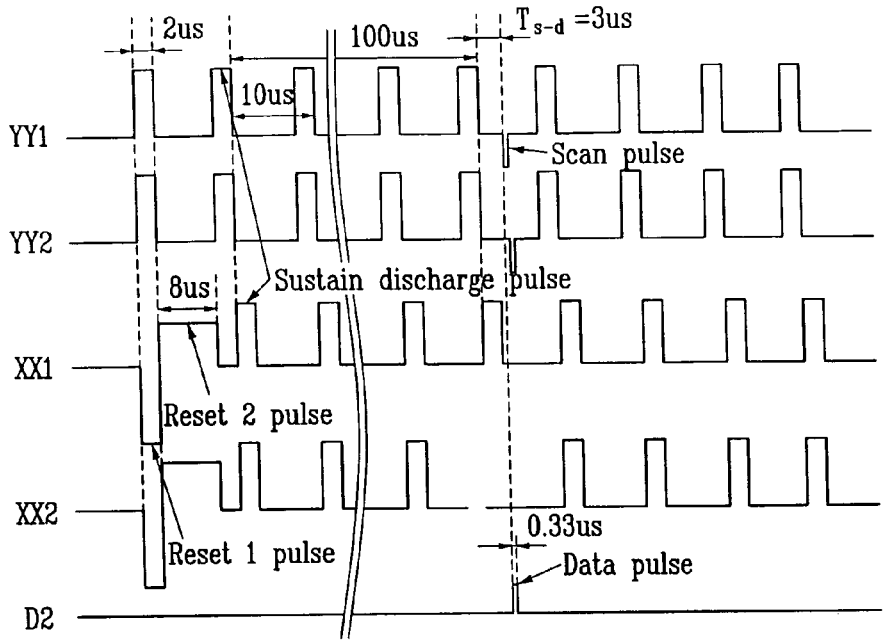
FIG. 4 is a driving waveform diagram showing the measurement of the margins of the scan pulse voltage and the data pulse voltage of FIG. 3A.

FIG. 4 is a driving waveform diagram for measuring margins of the scan pulse voltage and the data pulse voltage of FIG. 3A. $T_{s-d}$ represents the time from the end of the sustain discharge to the start of the next scan pulse voltage application, which is 3 μs (microseconds). All the scan and data pulses have a width of 0.33 μs.

Figure 5:
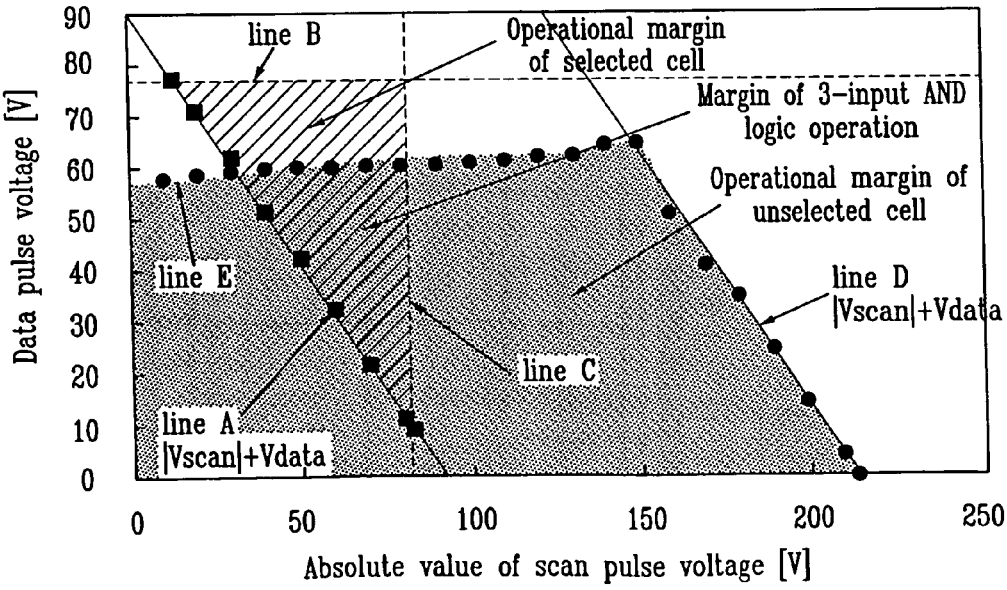
FIG. 5 shows the absolute value $|V_{scan}|$ of the scan pulse voltage and the measurement of the operational margin of the data pulse voltage $V_{data}$ according to an embodiment of the present invention.

FIG. 5 shows the absolute value $|V_{scan}|$ of the scan pulse voltage and the measurement of the operational margin of the data pulse voltage $V_{data}$ according to the embodiment of the present invention. The voltage and the width of pulses used in the driving waveform diagram of FIG. 4 are presented in Table 1.

TABLE 1

| | Pulse voltage | Pulse width (μs) |
|---|---|---|
| Sustain discharge pulse | 155 V | 2 |
| Reset 1 pulse | −190 V | 2 |
| Reset 2 pulse | 145 V | 8 |
| Scan pulse | $V_{scan}$ | 0.33 |
| Data pulse | $V_{data}$ | 0.33 |

In FIG. 4, an address erasure occurs even when the cell $Y_3$-$X_3$-$D_2$ defined by the scan electrode common line $YY_1$, the sustain electrode common line $XX_2$, and the data electrode $D_2$ are selected (refer to FIG. 2). If the absolute value of the scan pulse voltage $|V_{scan}|$ exceeds 82 V in this case, a discharge occurs without a data pulse voltage being applied. Alternatively, if the data pulse voltage $V_{data}$ exceeds 76 V (volts), a discharge occurs without a scan pulse voltage being applied. For the address erasure, the sum $|V_{scan}|+V_{data}$ of the absolute value of the scan pulse voltage and the data pulse voltage must exceed 90 V.

For unselected cells, a unnecessary discharge occurs between the data electrode and the sustain electrode when the data pulse voltage $V_{data}$ exceeds 60 V, and between the data electrode and the scan electrode when the sum $|V_{scan}|+V_{data}$ of the absolute value of the scan pulse voltage and the data pulse voltage exceeds 210 V.

Accordingly, the operational margin of the data pulse voltage and the scan pulse voltage according to the embodiment of the present invention is the overlapping area (defined by lines A, C, and E) of the operational margin area of the selected cell (defined by lines A, B, and C) and the operational margin area of the unselected cells (defined by lines D and E).

Hereinafter, a description will be given as to the operational margin of the scan pulse voltage and the data pulse voltage when the time $T_{s-d}$ from the end of the sustain discharge to the start of the next scan pulse voltage application is variable between 2.33 μs and 7.33 μs, with reference to FIGS. 6 to 9.

Figure 6:
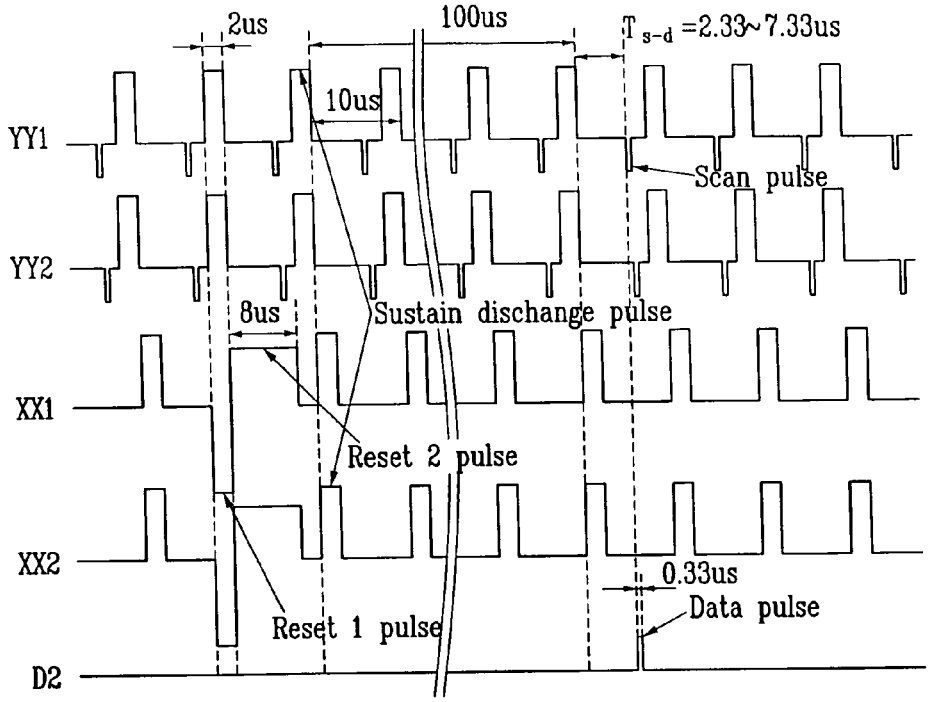
FIG. 6 is a driving waveform diagram for measuring the operational margin of the scan pulse voltage and the data pulse voltage according to an embodiment of the present invention.

FIG. 6 shows a driving waveform for measuring the operational margin of the scan pulse voltage and the data pulse voltage according to the embodiment of the present invention. The driving waveform of FIG. 6 is the same as that of FIG. 4, excepting that $T_{s-d}$ is variable between 2.33 μs and 7.33 μs, FIG. 7 shows the maximum of the absolute value of the scan pulse voltage $|V_{scan}|$ according to the change of $T_{s-d}$ when the data pulse voltage is 0V, according to the embodiment of the present invention.

Figure 7:
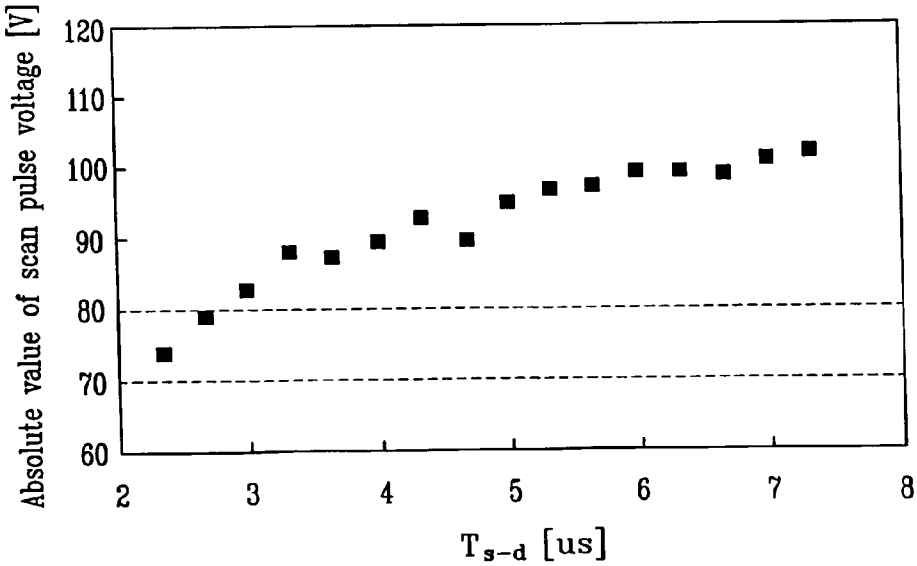
FIG. 7 shows the maximum of the absolute value of the scan pulse voltage $|V_{scan}|$ according to the change of $T_{s-d}$ when the data pulse voltage is 0V, according to an embodiment of the present invention.

In FIG. 7, the maximum of the absolute value of the scan pulse voltage $|V_{scan}|$ increases with an increase in $T_{s-d}$, because the priming effect caused by the sustain discharge is reduced with the greater $T_{s-d}$.

As can be seen from FIG. 7, $T_{s-d}$ must be longer than 2.33 μs for $|V_{scan}|$ of 70V and 2.8 μs for $|V_{scan}|$ of 80 V. Because the data pulse width is 0.33 μs, 16 data pulses can be applied during a time period of 0.33 to 7.33 μs when $|V_{scan}|$ is 70 V; and 14 data pulses can be applied during a time period of 2.8 to 7.33 μs when $|V_{scan}|$ is 80 V.

Figure 8:
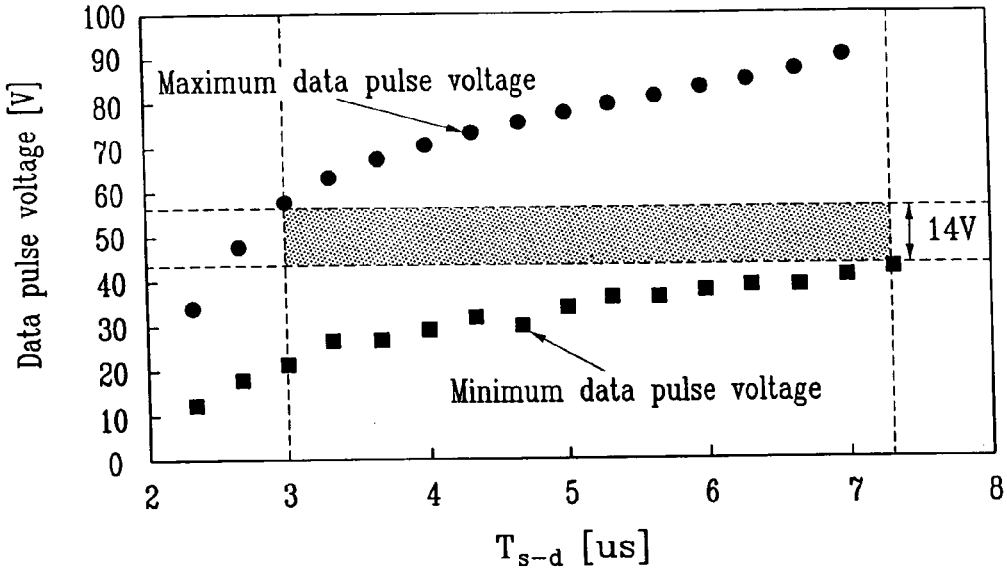
FIGS. 8 and 9 show the operational margin of the data pulse voltage for $T_{s-d}$ when the absolute value of the scan pulse voltage $|V_{scan}|$ is 70 V and 80 V, respectively, according to an embodiment of the present invention.
Figure 9:
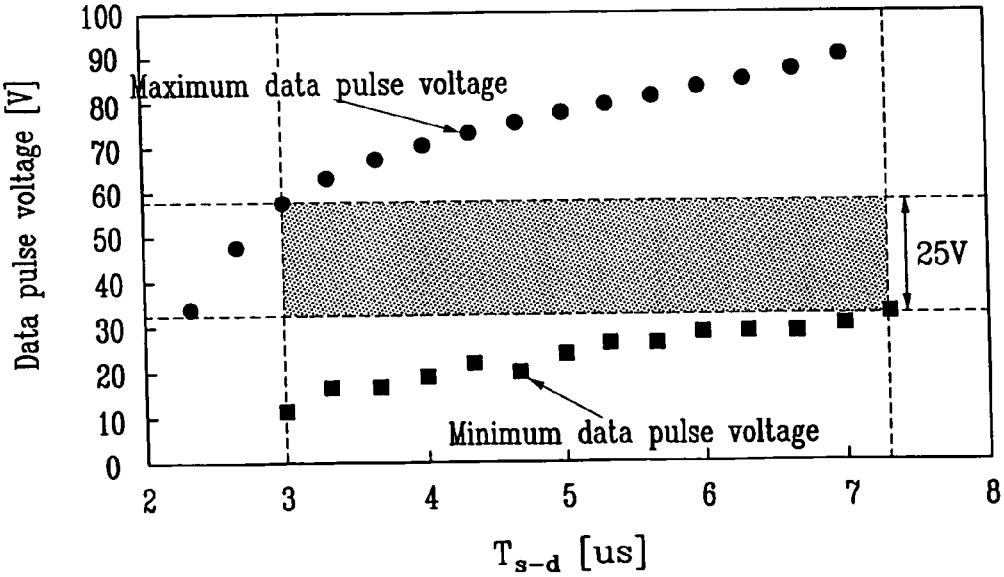

FIGS. 8 and 9 show the operational margin of the data pulse voltage for $T_{s-d}$ when $|V_{scan}|$ is 70 V and 80 V, respectively, according to the embodiment of the present invention. An address erasure occurs adequately when the data pulse voltage $V_{data}$ exceeds the minimum data pulse voltage value. But an unnecessary discharge occurs when the data pulse voltage $V_{data}$ exceeds the maximum data pulse voltage value. The minimum and maximum data pulse voltage values increase with an increase in $T_{s-d}$, because the number of priming particles is reduced.

In FIGS. 8 and 9, $T_{s-d}$ is variable between 3 and 7.33 μs. For $|V_{scan}|$ of 70 V, the margin the data pulse voltage is 14 V as defined by the area between the dotted lines in FIG. 8. For $|V_{scan}|$ of 80 V, and the margin of the data pulse voltage is 25 V as defined by the area between the dotted lines in FIG. 9.

But, when the scan and data pulses having a width of 0.33 μs are applied in succession, these pulses are combined to broaden the pulse width. With an increase in the pulse width, the minimum data pulse voltage increases and thereby the operational margin of the data pulse voltage decreases.

To compensate for the reduced operational margin of the data pulse voltage with the broadened pulse width, a bias pulse voltage is applied between the sustain discharge pulses. Hereinafter, a description will be given as to the operational margin of the data pulse voltage based on the bias pulse voltage applied, with reference to FIGS. 10 and 11.

Figure 10:
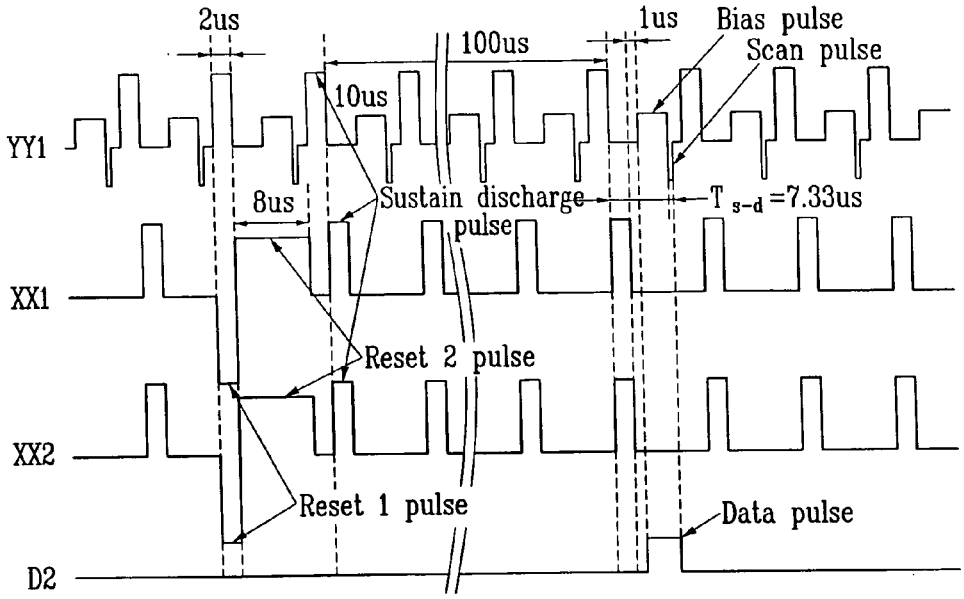
FIG. 10 shows a driving voltage waveform of a PDP with a bias pulse voltage applied, according to an embodiment of the present invention.
Figure 11:
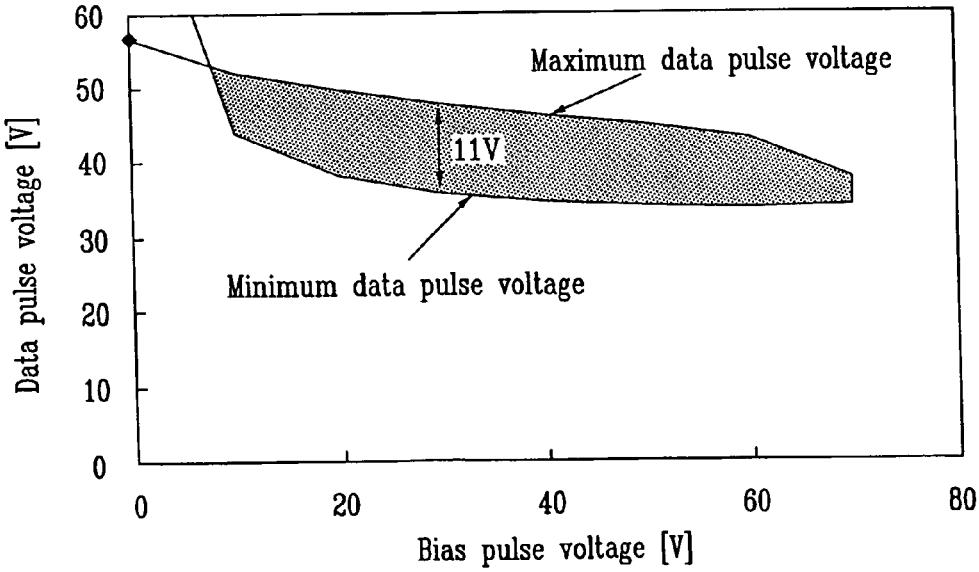
FIG. 11 shows the measurement of the operational margin of the data pulse voltage based on the change of the bias pulse voltage according to an embodiment of the present invention.

FIG. 10 shows a driving voltage waveform of a PDP with a bias pulse voltage applied, according to the embodiment of the present invention, and FIG. 11 shows the operational margin of the data pulse voltage based on the change of the bias pulse voltage according to the embodiment of the present invention.

As illustrated in FIG. 10, the bias pulse voltage is applied to the scan electrode common line $YY_1$ when 14 data pulse voltages are applied in succession under the conditions of FIG. 2 with $T_{s-d}$ of 7.33 μs.

TABLE 2

| | Pulse voltage | Pulse width (μs) |
|---|---|---|
| Sustain discharge pulse | 155 V | 2 |
| Reset 1 pulse | −190 V | 2 |
| Reset 2 pulse | 145 V | 8 |
| Scan pulse | −80 V | 0.33 |

As shown in FIG. 11, there is no operational margin when the bias pulse voltage is 0V. The minimum data pulse voltage decreases with an increase in the bias pulse voltage. As in the case of FIG. 8, the minimum data pulse voltage is decreased to 34 V when the bias pulse voltage exceeds 50 V. On the other hand, the maximum data pulse voltage also decreases with an increase in the bias pulse voltage to narrow the operational margin. For the maximum of the operational margin, the bias pulse voltage amounts to 30 V, in which case the data pulse voltage margin is 11 V.

Hereinafter, a description will be given as to a general PDP and its driving method according to an embodiment of the present invention with reference to FIGS. 12 and 13.

Figure 12:
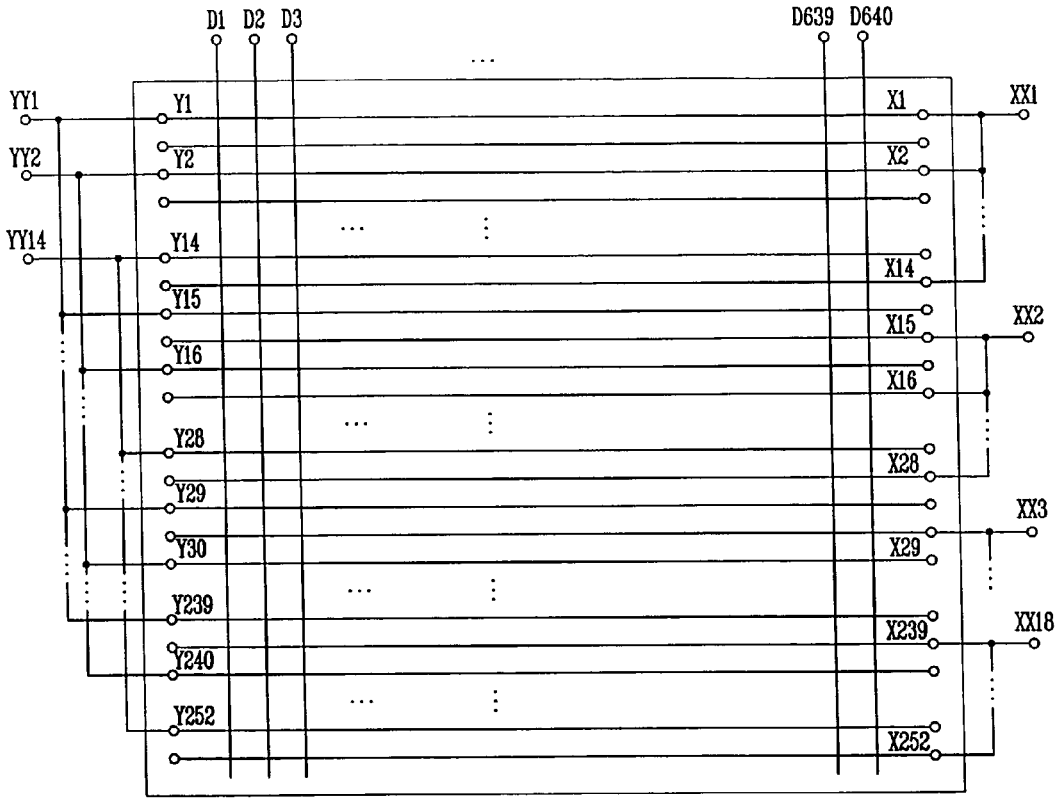
FIG. 12 is a general electrode connection diagram of a PDP according to an embodiment of the present invention.

FIG. 12 is a general electrode connection diagram of a PDP according to an embodiment of the present invention.

The PDP according to the embodiment of the present invention is enabled to apply 14 scan pulse voltages every 10 μs, and it includes more than 240 scan electrodes. In the PDP, as illustrated in FIG. 12, the electrodes are divided into 18 groups each of which includes 14 adjacent scan and sustain electrodes.

Namely, as shown in FIG. 12, the sustain electrodes of the same group are coupled in common to one of 18 sustain electrode common lines $XX_1$ to $XX_{18}$, and 14 scan electrodes of the same group are independently coupled to a different one of 14 scan electrode common lines $YY_1$ to $YY_{14}$.

Figure 13:
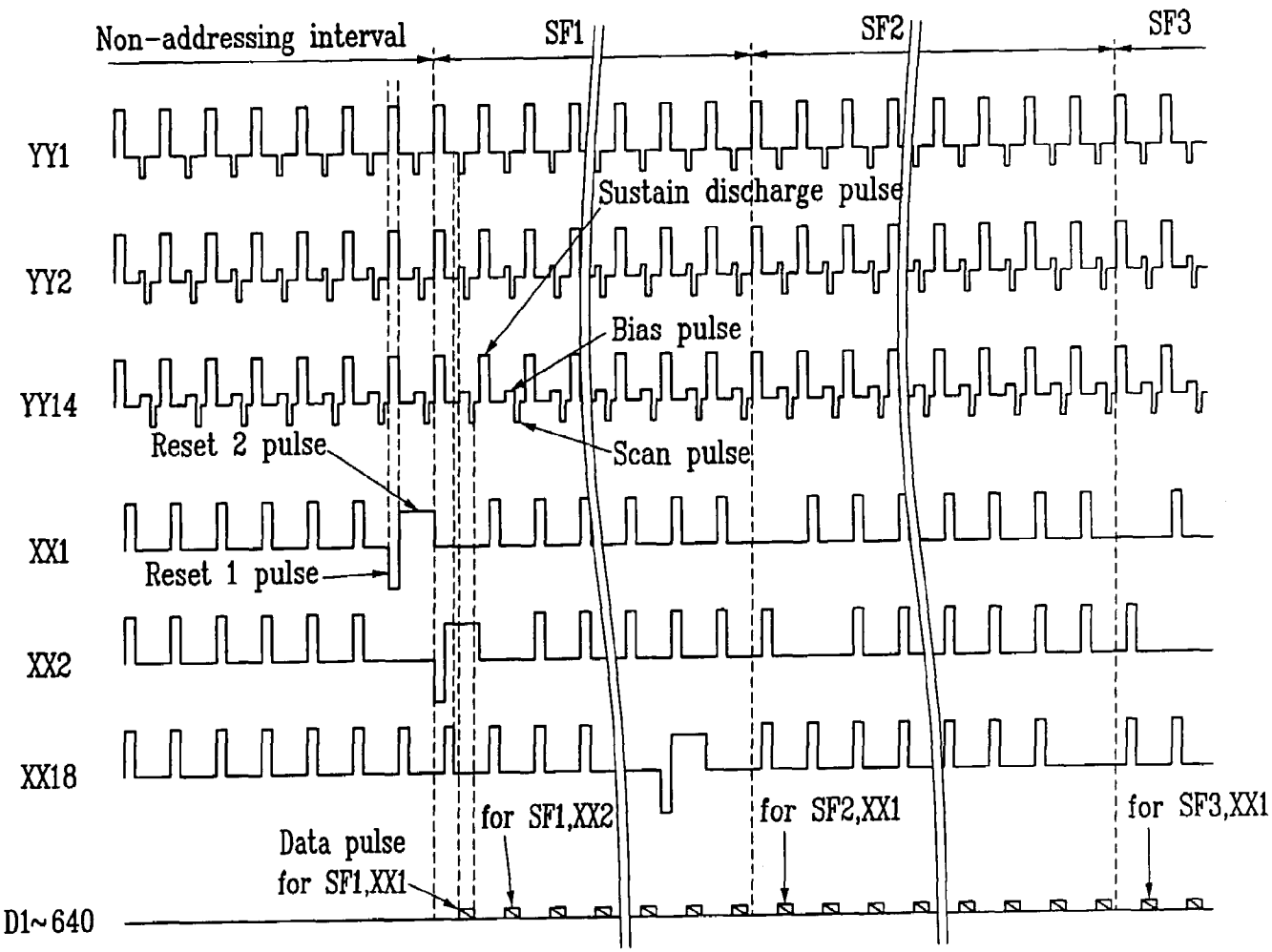
FIG. 13 shows a driving voltage waveform for driving the PDP according to an embodiment of the present invention.

FIG. 13 shows a driving voltage waveform for driving the PDP according to the embodiment of the present invention. In FIG. 13, one TV field consists of 92 sub-fields, each of which has a length of 180 μs.

As illustrated in FIG. 13, scan pulse voltages are applied to the scan electrode common lines $YY_1$ to $YY_{14}$ between the sustain discharge voltage pulses for one TV field. The scan pulse voltage applied to the scan electrode common line $YY_2$ is 0.33 μs later than that applied to the scan electrode common line $YY_1$. Likewise, the scan pulse voltage applied to the scan electrode common line $YY_{i+1}$ is 0.33 μs later than that applied to the scan electrode common line $YY_i$. The data pulse voltage is applied to the data electrodes $D_1$ to $D_{640}$ in synchronization with the scan pulse voltage.

On the other hand, reset pulse voltages are applied to the sustain electrode common lines $XX_1$ to $XX_{18}$, as shown in FIG. 13. The reset pulse voltage applied to the sustain electrode common line $XX_2$ is applied 10 μs later than that applied to the sustain electrode common line $XX_1$. Likewise, the reset pulse voltage applied to the sustain electrode common line $XX_{i+1}$ is applied 10 μs later than that applied to the sustain electrode common line $XX_i$.

To realize a 3-input AND logic operation, sustain discharge voltages are eliminated from the sustain electrode common lines $XX_1$ to $XX_{18}$. As illustrated in FIG. 13, the sustain discharge voltage of the sustain electrode common line $XX_{i+1}$ is eliminated 10 μs later than that of the sustain electrode common line $XX_i$. The erasure of the sustain discharge voltage pulses occurs every 180 μs.

As shown in FIG. 13, the reset pulse voltage is applied to each of the sustain electrode common lines $XX_1$ to $XX_{18}$ only once in one TV field. Hence, the sustain discharge occurs in succession over 92 sub-fields, because there is no rest step between the sub-fields.

In the principle of the 3-input AND logic operation, a sustain discharge does not occur for one TV field, once an address erasure is carried out to erase the sustain discharge voltage and apply the data pulse voltage in a synchronous way. The 92 sub-fields allow a display of 93 gradations.

Additionally, as shown in FIG. 13, a bias pulse is applied to the scan electrode common lines $YY_1$ to $YY_{14}$ to broaden the driving margin of the data pulse voltage.

The present invention can be also realized as computer-executable instructions in computer-readable media. The computer-readable media includes all possible kinds of media in which computer-readable data is stored or included or can include any type of data that can be read by a computer or a processing unit. The computer-readable media include for example and not limited to storing media, such as magnetic storing media (e.g., ROMs, floppy disks, hard disk, and the like), optical reading media (e.g., CD-ROMs (compact disc-read-only memory), DVDs (digital versatile discs), rewritable versions of the optical discs, and the like), hybrid magnetic optical disks, organic disks, system memory (read-only memory, random access memory), non-volatile memory such as flash memory or any other volatile or non-volatile memory, other semiconductor media, electronic media, electromagnetic media, infrared, and other communication media such as carrier waves (e.g., transmission via the Internet or another computer). Communication media generally embodies computer-readable instructions, data structures, program modules or other data in a modulated signal such as the carrier waves or other transportable mechanism including any information delivery media. Computer-readable media such as communication media may include wireless media such as radio frequency, infrared microwaves, and wired media such as a wired network. Also, the computer-readable media can store and execute computer-readable codes that are distributed in computers connected via a network. The computer readable medium also includes cooperating or interconnected computer readable media that are in the processing system or are distributed among multiple processing systems that may be local or remote to the processing system. The present invention can include the computer-readable medium having stored thereon a data structure including a plurality of fields containing data representing the techniques of the present invention.

Figure 14:
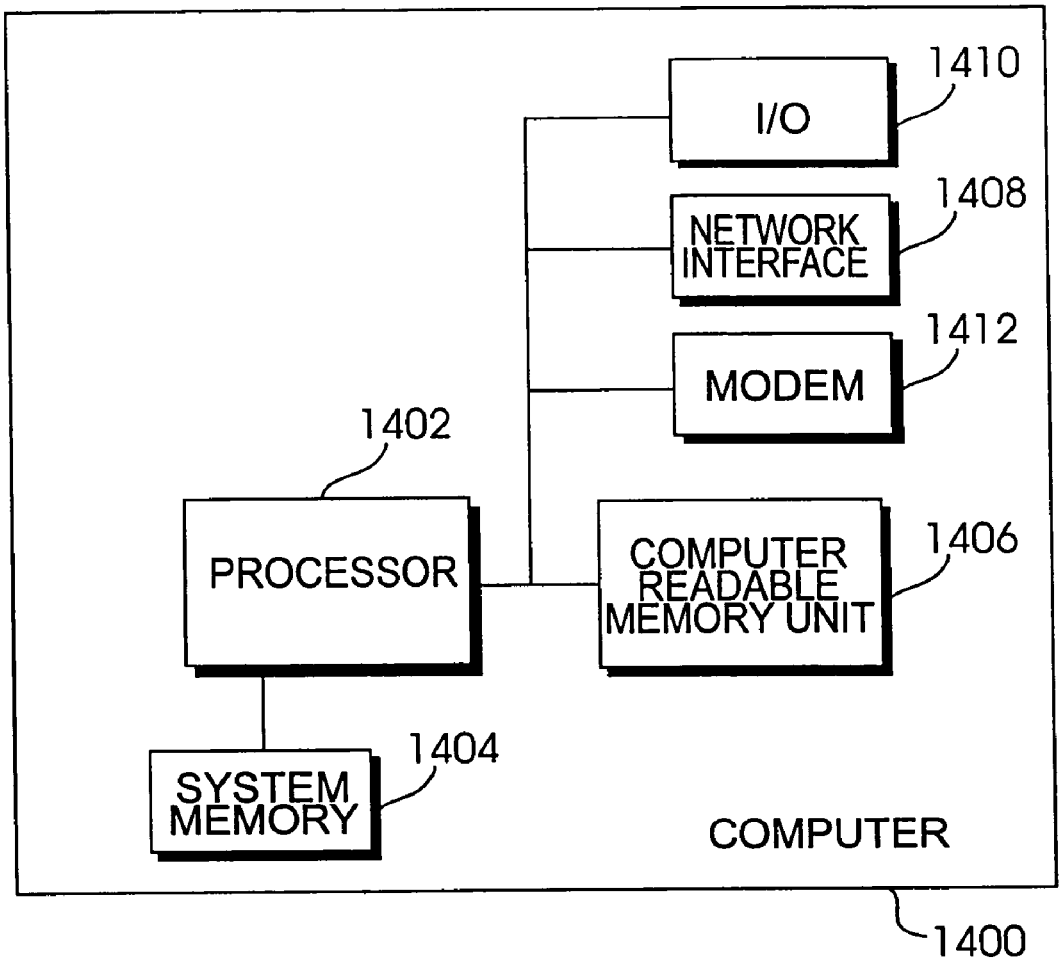
FIG. 14 shows an example of a computer including a computer-readable medium having computer-executable instructions for performing a method of the present invention.

An example of a computer, but not limited to this example of the computer, that can read computer readable media that includes computer-executable instructions of the present invention is shown in FIG. 14. The computer 1400 includes aprocessor 1402 that controls the computer 1400. The processor 1402 uses the system memory 1404 and a computer readable memory device 1406 that includes certain computer readable recording media. A system bus connects the processor 1402 to a network interface 1408, modem 1412 or other interface that accommodates a connection to another computer or network such as the Internet. The system bus may also include an input and output interface 1410 that accommodates connection to a variety of other devices.

As described above, in the method for driving a PDP according to the present invention, no more than one reset pulse voltage is applied for one TV field without a reset step between the respective sub-fields, thereby drastically reducing ineffective light and improving the contrast.

In the apparatus for driving a PDP according to the present invention, a plurality of scan and sustain electrodes arranged in pairs are divided into j groups each including i pairs of the scan and sustain electrodes, the sustain electrodes of a same group being coupled in common to j X electrode common lines, and the scan electrodes of a same group being coupled independently to a different one of i Y electrode common lines. Therefore, the present invention reduces the number of driver IC's for the scan and sustain electrodes from (i×j+1) to (i+j), thereby lowering the cost of the PDP.

Furthermore, the present invention realizes a high-brightness display because the sustain discharge pulse can be applied in succession in at most one TV field.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. A method of driving a plasma display panel, the method comprising:

providing a plasma display panel including a plurality of scan electrodes, a plurality of sustain electrodes, a plurality of data electrodes extending to a direction crossing to the scan and the sustain electrodes, and a plurality of discharge cells defined by the scan electrodes, the sustain electrodes, and the data electrodes, the discharge cells being divided into discharge cell groups including a first discharge cell group and a second discharge cell group, dividing one TV field into a plurality of subfields;

performing a reset operation by applying a first reset waveform and a second reset waveform subsequent to the first reset waveform to at least one of the discharge cells, the reset operation being performed during only a first subfield among the plurality of subfields;

applying a first sustain discharge pulse to the scan electrodes in a second subfield among the plurality of subfields;

selecting a discharge cell for an address erasure among the first discharge cell group after said applying the first sustain discharge pulse; and applying a second sustain discharge pulse to the scan electrodes in the second subfield after said selecting said discharge cell for the address erasure.

2. The method of claim 1, wherein the first reset waveform includes a first high level waveform applied to at least one of the scan electrodes and a first low level waveform applied to at least one of the sustain electrodes, a voltage of the first low level waveform being lower than a voltage of the first high level waveform, and the second reset waveform includes a second low level waveform applied to the at least one of the scan electrodes and a second high level waveform applied to the at least one of the sustain electrodes, a voltage of the second low level waveform being lower than a voltage of the second high level waveform.

3. The method of claim 1, wherein a length of a period during which the first reset waveform is applied is different from a length of a period during which the second reset waveform is applied.

4. The method of claim 1, wherein the selecting the discharge cell for an address erasure includes:

applying a scan pulse to a one of the scan electrodes that corresponds to the discharge cell selected for the address erasure, and applying a data pulse to a one of the data electrodes that corresponds to the discharge cell selected for the address erasure.

5. The method of claim 4, wherein a width of the scan pulse is approximately 0.33 μs.

6. The method of claim 1, further comprising selecting a discharge cell for an address erasure among the second discharge cell group before the applying of the first sustain discharge pulse in the second subfield.

7. The method of claim 1, wherein the scan electrodes and the sustain electrodes are arranged in pairs, the sustain electrodes are divided into a plurality of sustain electrode groups including a first sustain electrode group and a second sustain electrode group, the first discharge cell group includes a plurality of discharge cells defined by the first sustain electrode group, ones of the scan electrodes that correspond to the first sustain electrode group, and the data electrodes, and the second discharge cell group includes a plurality of discharge cells defined by the second sustain electrode group, ones of the scan electrodes that correspond to the second sustain electrode group, and the data electrodes.

8. The method of claim 1, the method being absent of any reset operation other than the reset operation occurring during the first subfield.

9. A plasma display panel, comprising:

a plurality of scan electrodes;

a plurality sustain electrodes, each sustain electrode and each scan electrode being arranged in a pair;

a plurality of data electrodes extending in a direction crossing the scan and the sustain electrodes;

a plurality of discharge cells defined by the scan electrodes, the sustain electrodes, and the data electrodes, the discharge cells being divided into discharge cell groups including a first discharge cell group and a second discharge cell group;

a controller adapted to divide a TV field into a plurality of subfields; and a driver adapted to perform a reset operation only once during one TV field by using a first reset waveform and a second reset waveform subsequent to the first reset waveform, perform a sustain discharge during a first period and a second period of a subfield, and select a discharge cell for an address erasure among the first discharge cell group during a third period between the first period and the second period.

10. The plasma display panel of claim 9, wherein the first reset waveform includes a first high level waveform and a first low level waveform having a lower voltage than the first high level waveform, and the second reset waveform includes a second high level waveform and a second low level waveform having a lower voltage than the second high level waveform, and wherein the driver is adapted to:

apply the first high level waveform to at least one of the scan electrodes;

apply the first low level waveform to at least one of the sustain electrodes;

apply the second low level waveform to the at least one of the scan electrodes; and apply the second high level waveform to the at least one of the sustain electrodes.

11. The plasma display panel of claim 9, wherein a length of a period of 2 the first reset waveform is different from a length of a period of the second reset waveform.

12. The plasma display panel of claim 9, wherein the driver is further adapted to:

apply a scan pulse to a one of the scan electrodes that corresponds to the discharge cell selected for the address erasure; and apply a data pulse to a one of the data electrodes that corresponds to the discharge cell selected for the address erasure.

13. The plasma display panel of claim 12, wherein a width of the scan pulse is approximately 0.33 μs.

14. The plasma display panel of claim 9, wherein the driver is further adapted to select a discharge cell for an address erasure among the second discharge cell group during a fourth period, the first period being subsequent to the fourth period.

15. The plasma display panel of claim 9, wherein the scan electrodes and the sustain electrodes are arranged in pairs, the sustain electrodes includes a first sustain electrode group and a second sustain electrode group, the first discharge cell group includes ones of the discharge cells defined by the first sustain electrode group, ones of the scan electrodes that correspond to the first sustain electrode group, and the data electrodes, and the second discharge cell group includes ones of the discharge cells defined by the second sustain electrode group, ones of the scan electrodes that correspond to the second sustain electrode group, and the data electrodes.

16. The plasma display panel of claim 9, wherein the reset operation occurs in the first subfield of the plurality of subfields, wherein the TV field is absent of any other additional reset operation.

17. A plasma display panel, comprising:

a plurality of sustain electrodes including a plurality of first sustain electrodes and a plurality of second sustain electrodes;

a plurality of scan electrodes including a plurality of first scan electrodes that correspond to the plurality of first sustain electrodes and a plurality of second scan electrodes that correspond to the plurality of second sustain electrodes;

a plurality of data electrodes extending in a direction crossing the scan and the sustain electrodes;

a plurality of discharge cells including a plurality of first discharge cells defined by the first scan electrodes, the first sustain electrodes, and the data electrodes, and a plurality of second discharge cells defined by the second scan electrodes, the second sustain electrodes, and the data electrodes;

a controller adapted to divide a TV field into a plurality of subfields; and a driver adapted to perform a reset operation by using a first reset waveform and a second reset waveform subsequent to the first reset waveform only once during one TV field, select a first discharge cell for an address erasure among the plurality of first discharge cells during a first period of a subfield, perform a sustain discharge during a second period subsequent to the first period in the subfield, select a second discharge cell for an address erasure among the plurality of second discharge cells during a third period subsequent to the second period in the subfield, and perform a sustain discharge during a fourth period subsequent to the third period in the subfield.

18. The plasma display panel of claim 17, wherein the driver is further adapted to apply the first reset waveform to at least one of the discharge cells, and apply the second reset waveform to the at least one of the discharge cells, wherein the first reset waveform includes a first high level waveform applied to at least one of the scan electrodes and a first low level waveform applied to at least one of the sustain electrodes, a voltage of the first low level waveform being lower than a voltage of the first high level waveform, and wherein the second reset waveform includes a second low level waveform applied to the at least one of the scan electrodes and a second high level waveform applied to the at least one of the sustain electrodes, a voltage of the second low level waveform being lower than a voltage of the second high level waveform.

19. The plasma display panel of claim 18, wherein a period during which the first reset waveform is applied is different from a period during which the second reset waveform is applied.

20. The plasma display panel of claim 17, wherein the driver is further adapted to apply a scan pulse to a first scan electrode that corresponds to the first discharge cell selected for the address erasure, and apply a data pulse to a one of the data electrodes that corresponds to the first discharge cell selected for the address erasure, and wherein a width of the scan pulse is approximately 0.33 μs.

* * * * *